US007749109B2

(12) United States Patent
Jang et al.

(10) Patent No.: US 7,749,109 B2
(45) Date of Patent: Jul. 6, 2010

(54) GOLF SWING POSTURE CORRECTION APPARATUS AND METHOD OF CORRECTING GOLF SWING POSTURE

(75) Inventors: Yong Won Jang, Daejeon (KR); Seunghwan Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 12/382,797

(22) Filed: Mar. 24, 2009

(65) Prior Publication Data

US 2009/0191985 A1 Jul. 30, 2009

Related U.S. Application Data

(62) Division of application No. 11/924,906, filed on Oct. 26, 2007, now Pat. No. 7,527,561.

(30) Foreign Application Priority Data

Dec. 7, 2006 (KR) ..... 10-2006-0124136

(51) Int. Cl.
*A63B 69/36* (2006.01)

(52) U.S. Cl. ..... 473/409; 473/215

(58) Field of Classification Search ..... 473/207–218, 473/266, 269, 277, 409, 422
See application file for complete search history.

(56) References Cited

U.S. PATENT DOCUMENTS 3,644,919 A 2/1972 Mathauser
4,577,868 A * 3/1986 Kiyonaga ..... 473/269
5,064,192 A 11/1991 Smith
5,300,921 A 4/1994 Hoch et al.
5,344,323 A 9/1994 Burns
5,372,365 A * 12/1994 McTeigue et al. ..... 473/409
5,433,201 A 7/1995 Manthey
5,511,789 A 4/1996 Nakamura
5,993,323 A 11/1999 Linenfelser
6,001,023 A 12/1999 Sanchez et al.
6,428,421 B1 8/2002 Halfacre
7,383,728 B2 6/2008 Noble et al.
7,527,561 B2 * 5/2009 Jang et al. ..... 473/215
2002/0183657 A1 12/2002 Socci et al.
2004/0225236 A1 11/2004 Wheeler et al.
2005/0046576 A1 3/2005 Julian et al.

FOREIGN PATENT DOCUMENTS

KR 10-2000-0012287 3/2000
KR 10-2000-0055798 9/2000

OTHER PUBLICATIONS

"Kinematic Analysis and Measurement of Sports Form—Measurement of Golf Driver Swing Form-" by Masaki Hokari et al., T. Sice, vol. 38, No. 11, pp. 922-930, 2002.

* cited by examiner

*Primary Examiner*—Nini Legesse
(74) *Attorney, Agent, or Firm*—Rabin & Berdo, PC

(57) ABSTRACT

A golf swing posture correction apparatus and method therefor are provided. Provided is the golf swing posture correction system apparatus capable of detecting movement of an anchored leg in a golf swing and notifying a user, thereby correcting a golf swing posture. The anchored leg is a left leg for a right-handed person and a right leg for a left-handed person. The golf swing posture correction apparatus detects the movement of the anchored leg, and processes a detected signal, thereby generating sound via a speaker or vibration.

2 Claims, 4 Drawing Sheets

GOLF SWING POSTURE CORRECTION APPARATUS AND METHOD OF CORRECTING GOLF SWING POSTURE

RELATED APPLICATION

This is a Divisional of U.S. application Ser. No. 11/924,906, filed Oct. 26, 2007, and allowed on Jan. 28, 2009, the subject matter of which is incorporated herein by reference.

BACKGROUND OF THE INVENTION

1. Field of the Invention

The present invention relates to a golf swing posture correction apparatus and method of correcting a golf swing posture, and more particularly, to a golf swing posture correction system capable of detecting movement of an anchored leg in a golf swing and notifying a user, thereby correcting a golf swing posture. In other words, it is a system helping the anchored leg to be fixed since the anchored leg has to be still in the golf swing.

This work was supported by the IT R&D program of MIC/IITA. [2006-S007-01, Ubiquitous Health Monitoring Module and System Development]

2. Description of the Related Art

Golf is widely starting to be played by the general public and has become one of the most often played sports by people. However, golf is one of the most difficult sports since it is very difficult to achieve a correct golf swing posture, and due to this, various auxiliary items for correcting the golf swing posture are available in the market. The purpose of the present invention is as an auxiliary apparatus for helping golfers achieve a correct golf swing posture.

From among previously published patents for correcting a golf swing posture, the invention, Device for correcting head posture in golf (Korea Patent Laid-Open Publication No. 2000-0055798) which was applied to the Korean Intellectual Property Office (KIPO) on Feb. 10, 1999 by Gil-hyup GEONG et al. and published on Sep. 15, 2000, discloses a device for helping the head to be still and not be looking up. The device has specialized designs such as an in-the-ear type system, an earplug type system, and the like, and prevents the head from moving. The problems of the cited invention is that the device is only specially for correcting the head posture, and the in-the-ear type system according to the cited invention requires minimization thereby causing various restrictions regarding the embodiments of the cited invention. Also, such invention is costly in terms of manufacturing.

Another prior art, the invention, Method and apparatus for correction golf pose (Korea Patent Registration No. 0336415) which was applied to KIPO on Nov. 18, 1999 by Gwang-bae KIM and published on Mar. 6, 2000, discloses an apparatus developed in the form of a mat in which a swing detecting sensor at a level with a position of a pin on which a ball is to be put is attached thereby enabling a trace of a golf swing to be corrected. The apparatus employs an optical sensor located at front/back of the ball according to the traces of the back swing and down swing, thereby correcting the trace of the golf swing. However, the cited invention is limited in terms of tracing the golf swing and is difficult to be easily carried by golfers due to the carrying of the mat when golfers practice on an actual golf course.

Another prior art, the invention, *Kinematic analysis and measurement of sports form: Measurement of golf driver swing form* published in Japanese Journal of Instrumentation and Automation Control Institute in November, 2002 by Masaki HOKARI et al. for quantitatively analyzing a trace of a golf swing, discloses a system capable of quantitatively analyzing movement of the body in the golf swing. However, the system is quantitatively analyze changes of the body in the golf swing, and is surely different from qualitative detection for correcting the golf swing posture. Such results that are received from information of sensors attached to various parts of the body have to be analyzed using a computing system such as a personal computer (PC), and thus causing inconveniences to a golfer, and it is also difficult to carry the system in an actual golf course when the system is used.

SUMMARY OF THE INVENTION

In order to solve the aforementioned problems, the present invention provides a golf swing posture correction apparatus including a sensor unit detecting movement in various directions of an anchored leg, a control unit processing signals received from the sensor unit and generating result signals, a notification unit receiving the result signals from the control unit thereby generating either sound via a speaker or vibration, and a wearing unit enabling a system of the golf swing posture correction apparatus to be worn in a feasible part of the body, thereby providing a system having high usability and to more efficiently correct a golf swing posture. The present invention is designed so as to be highly portable, thereby capable of being worn in a golf course. When correction is required, the present invention immediately notifies a golfer, thereby enabling the posture of the golfer to be immediately corrected.

According to an aspect of the present invention, there is provided a golf swing posture correction apparatus according to a movement of an anchored leg in a golf swing, the golf swing posture correction apparatus including an angular speed sensor detecting rotary movement of the anchored leg in the golf swing; an acceleration sensor detecting one of vertical and horizontal movements of the anchored leg in the golf swing; a control unit receiving signals related to the movement detected by one of the angular speed sensor and the acceleration sensor, and determining whether the anchored leg moves, thereby outputting a control signal; and a notification unit receiving the control signal and notifying a golfer of the movement of the anchored leg.

According to another aspect of the present invention, there is provided a method of correcting a golf swing posture according to a movement of an anchored leg in a golf swing, the method including the operations of detecting rotary movement of the anchored leg in the golf swing; detecting one of vertical and horizontal movement of the anchored leg in the golf swing; receiving signals related to the detected movement, and determining whether the anchored leg has moved; and notifying a golfer of the movement of the anchored leg via a notification signal, if the movement of the anchored leg has occurred.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those of ordinary skill in the art.

Figure 1:
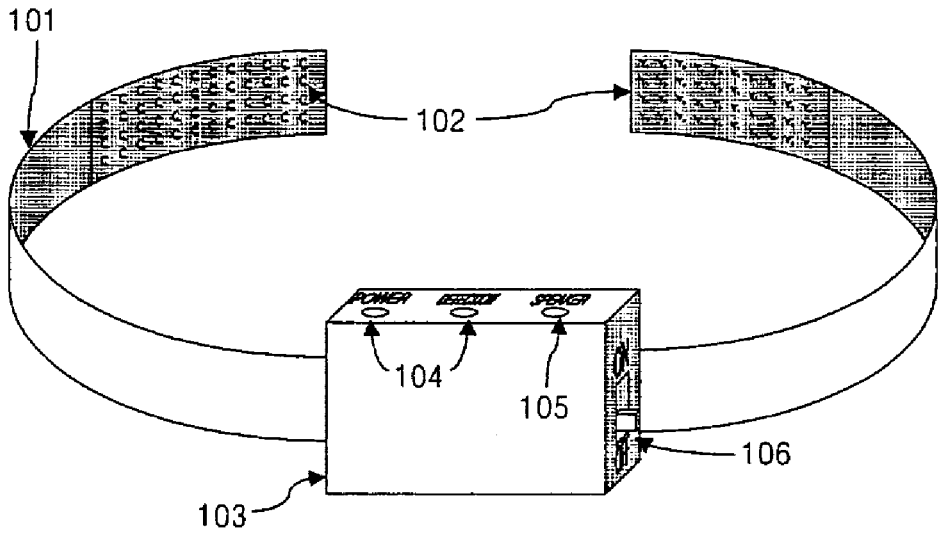
FIG. 1 is a perspective view diagram illustrating a golf swing posture correction apparatus according to an embodiment of the present invention.

FIG. 1 is a perspective view diagram illustrating a golf swing posture correction apparatus for correcting a golf swing posture according to an embodiment of the present invention.

Referring to FIG. 1, the golf swing posture correction apparatus includes a wearing unit 101 capable of being worn on an anchored leg, a Velcro™ strap 102, a housing unit 103 of a main body of a system, a status display unit 104, a sound output unit 105, and a power on/off switch unit 106.

In golf, posture is the most important thing. In particular, the anchored leg in the golf swing supports the whole procedure, and thus the anchored leg is the most important part in the golf swing. If the anchored leg is unstable, the back swing or down swing cannot be properly performed, and even when the head is not looking up, the back swing or down swing cannot be properly performed. Hence, an apparatus for detecting the movement of the anchored leg is one that can be directly worn on the anchored leg or a body part adjacent to the anchored leg, as illustrated in FIG. 1.

The golf swing posture correction apparatus 200 is specifically described below.

Figure 2:
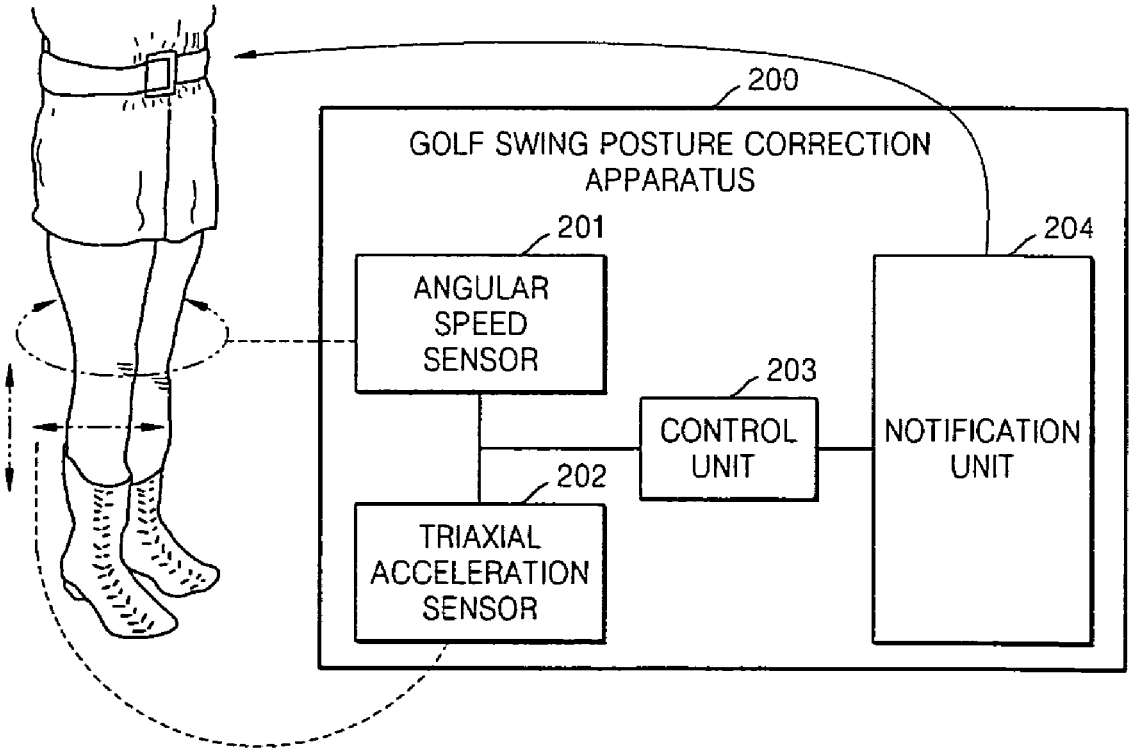
FIG. 2 is a diagram illustrating a configuration of the golf swing posture correction apparatus, according to an embodiment of the present invention.

FIG. 2 is a diagram illustrating a configuration of the golf swing posture correction apparatus 200, according to an embodiment of the present invention.

Referring to FIG. 2, the golf swing posture correction apparatus 200, detecting the movement of the anchored leg, includes an angular speed sensor 201 detecting rotary movement of the anchored leg in the golf swing; an acceleration sensor 202 detecting either vertical or horizontal movement of the anchored leg in the golf swing; a control unit 203 receiving signals related to the movement detected by at least one of the angular speed sensor 201 and the acceleration sensor 202, and determining whether the anchored leg moves, thereby outputting a control signal; and a notification unit 204 receiving the control signal and notifying a golfer of the movement of the anchored leg.

In addition, the wearing unit 101 can be attached to either the anchored leg of the golfer or another body part of the golfer, and via the wearing unit 101, the notification unit 204 may notify the golfer of the movement of the anchored leg by directly transmitting a signal to a body part on which the wearing unit 101 is attached.

The control unit 203 refers to a predetermined reference signal. Only when the control unit 203 receives a signal having an amplitude greater than that of the predetermined reference signal, wherein the signal is related to the movement, the control unit 203 determines that the movement of the anchored leg occurred, thereby outputting the control signal. The control signal, apart from the case when the control signal is used to notify the movement of the anchored leg, may also notify the golfer regarding either direction or degree of movement of the anchored leg. For example, it may be possible to output a control signal indicating either the direction of the movement of the anchored leg such as left or right, up or down, clockwise or counterclockwise, and the like, or the degree of movement of the anchored leg such as high, middle, or low.

The notification unit 204 notifies the golfer via a notification signal that may either be sound or vibration. Also, in order to notify with the notification signal, additional components such as a speaker or a vibration motor are required.

The golf swing posture correction apparatus 200 is not only limited to analyzing the movement of the anchored leg, however also may be a golf posture correction apparatus related to any body part that needs to be analyzed and corrected in terms of movement.

Figure 3:
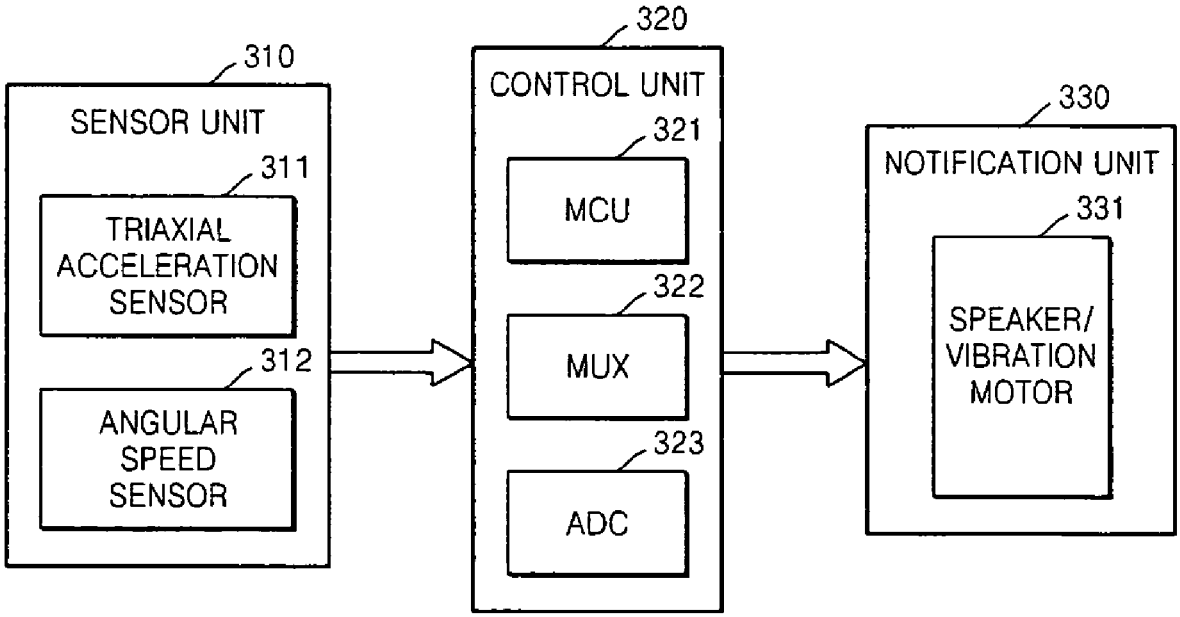
FIG. 3 is a block diagram illustrating the configuration in detail of the golf swing posture correction apparatus illustrated in FIG. 2, according to an embodiment of the present invention.

FIG. 3 is a block diagram illustrating the configuration in detail of the golf swing posture correction apparatus illustrated in FIG. 2, according to an embodiment of the present invention.

FIG. 3 is the block diagram illustrating the configuration within the housing unit 103 illustrated in FIG. 1, wherein the configuration is a detailed diagram of the configuration illustrated in FIG. 2 and includes a sensor unit 310, a control unit 320, and a notification unit 330. Referring to FIG. 3, the sensor unit 310 includes a triaxial acceleration sensor 311 detecting movement of an anchored leg, and an angular speed sensor 312 detecting rotation of the anchored leg.

The signals output from the sensor unit 310 are transmitted to the control unit 320. If the control unit 320 determines that the signals output from the sensor unit 310 are result values resulting from the movement of the anchored leg, by using a Micro Controller Unit (MCU) 321, a Multiplexer (MUX) 322, and an Analog to Digital Converter (ADC) 323, then the control unit 320 transmits a control signal to the notification unit 330. The notification unit 330 notifies a user of right/wrong related to golf swing via either a bell sound or vibration by using a speaker/vibration motor 331. At this point, since the bell sound may affect other people close to a golfer, an option may be possible to select between the bell sound and vibration.

Figure 4:
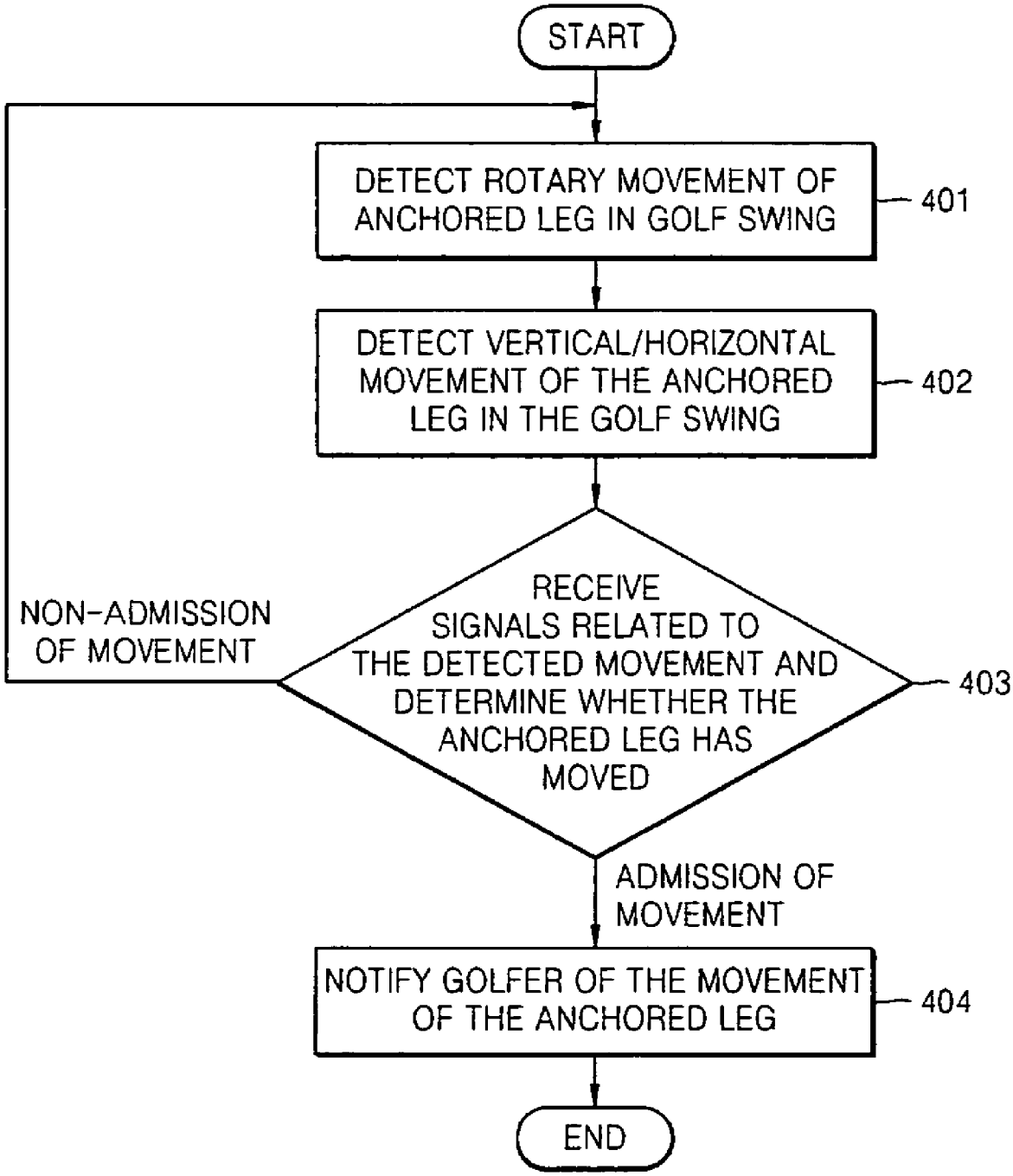
FIG. 4 is a flowchart illustrating a method of correcting a golf swing posture, according to an embodiment of the present invention.

FIG. 4 is a flowchart illustrating a method of correcting a golf swing posture according to the movement of an anchored leg in a golf swing, according to an embodiment of the present invention.

Referring to FIG. 4, if rotary movement of the anchored leg in the golf swing is detected in operation 401 and vertical or horizontal movement of the anchored leg in the golf swing is detected in operation 402, signals related to the detected movement are received so that whether or not the anchored leg moves is determined in operation 403.

As a result, if it is determined that the movement of the anchored leg has occurred, the movement of the anchored leg is notified to a golfer via a notification signal in operation 404. At this point, there is no order between the detection of the rotary movement of the anchored-leg and the detection of the vertical or horizontal movement of the anchored leg, thus when any movement is detected, a signal related to the movement is transmitted. According to whether the signal related to the detected movement has an amplitude greater than that of a predetermined reference signal, the actual movement of the anchored leg is determined in operation 403.

When the notification signal is notified, the notification signal, apart from the bell sound or the vibration, includes any signals capable of notifying of the movement of the anchored leg.

Figure 5:
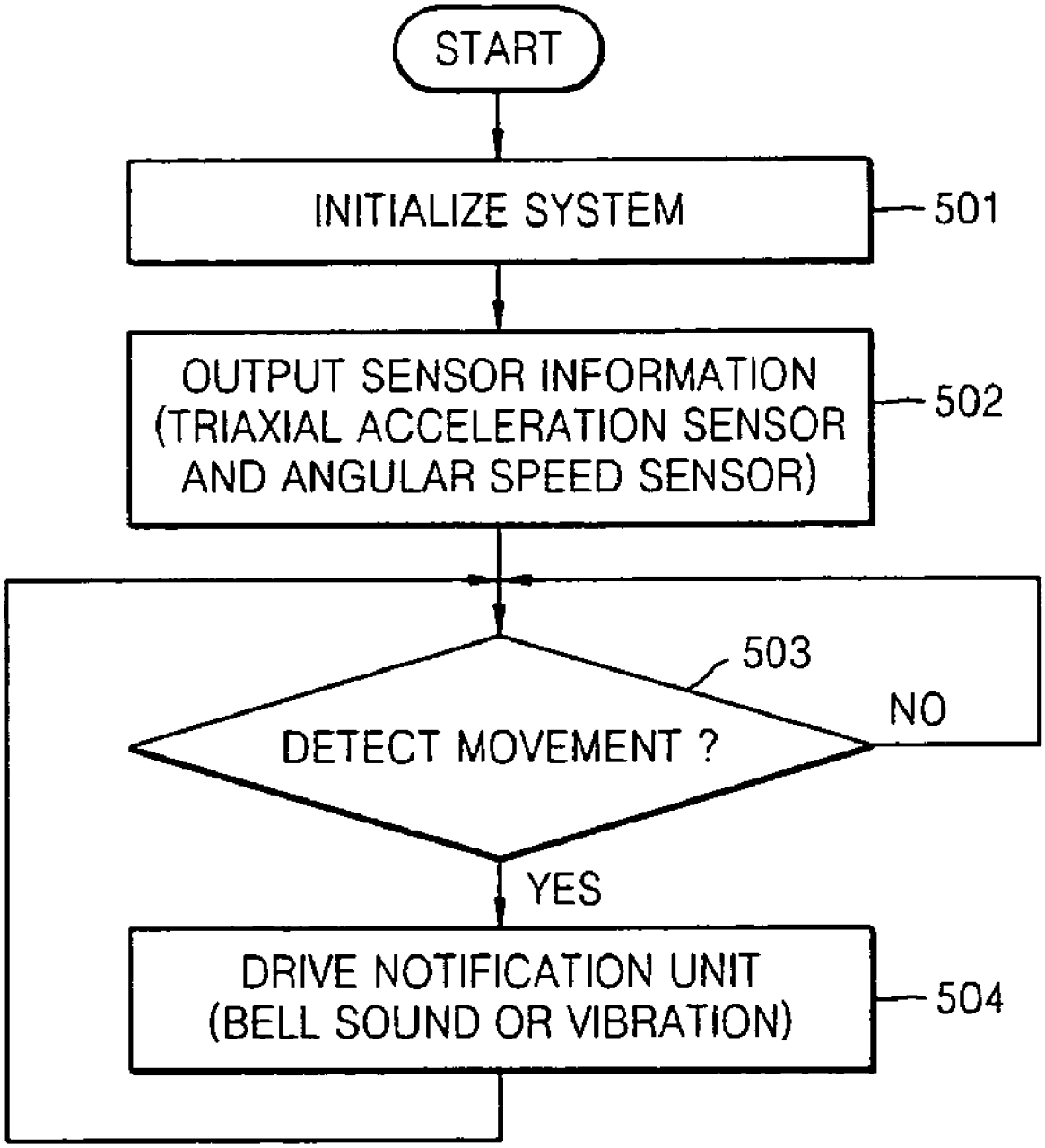
FIG. 5 is a flowchart illustrating a processing method of the golf swing posture correction apparatus, according to an embodiment of the present invention.

FIG. 5 is a flowchart illustrating a processing method of the golf swing posture correction apparatus 200 according to an embodiment of the present invention.

When the power on/off switch unit 106 illustrated in FIG. 1 is initially turned on, the golf swing posture correction apparatus 200 undergoes a system initialization process related to the golf swing posture correction apparatus 200 in operation 501. After the system initialization process, each of the angular speed sensor 201 and the acceleration sensor 202 detects movement of an anchored leg, thereby outputting information in the form of a signal in operation 502.

At this point, if the movement of the anchored leg is detected in operation 503, the notification unit 204 transmits a control signal related to the movement of the anchored leg, thereby notifying a user via either a bell sound or vibration in operation 504. However, if the movement is not detected in operation 503, the golf swing posture correction apparatus 200 remains on standby until movement of the anchored leg is detected again.

As described above, the apparatus of the present invention can detect the movement of the anchored leg and immediately notify a user, thereby enabling right/wrong related to a golf swing posture to be immediately determined and the apparatus can be carried so as to play golf at a golf course to practice on the golf swing. Since the anchored leg is the most important part in the golf swing, detection of the movement related to the anchored leg enables the golf swing posture to be more efficiently corrected, in comparison with detection of any other body part. In particular, the present invention can be worn not only in a practice location to practice a golf swing, however also can be worn at the golf course, thereby having high portability and high usability. The present invention can immediately notify a golfer of the movement of the anchored leg so that the golfer can immediately correct an incorrect posture.

The invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, hard disks, floppy disks, flash memory, optical data storage devices, and carrier waves (e.g., transmission through the Internet). The computer readable recording medium can also be distributed over network coupled computer systems so that the computer readable code is stored and executed in a distributed fashion. Also, functional programs, codes, and code segments for accomplishing the present invention can be easily constructed by programmers skilled in the art to which the present invention pertains.

While this invention has been particularly shown and described with reference to exemplary embodiments thereof, it will be understood by those of ordinary skill in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A method of correcting a golf swing posture according to a movement of an anchored leg in a golf swing, the method comprising:

detecting rotary movement of the anchored leg in the golf swing to output a rotary movement signal;

detecting one of vertical and horizontal movement of the anchored leg in the golf swing to output a linear movement signal;

receiving the rotary movement and linear movement signals, and determining that the anchored leg has moved if an amplitude of the rotary movement signal is greater than that of a predetermined reference signal and also if an amplitude of the linear movement signal is greater than that of the predetermined reference signal; and notifying a golfer of the movement of the anchored leg via a notification signal, if the movement of the anchored leg has occurred.

2. The method of claim 1, wherein the notification signal is at least one of a bell sound and vibration.

* * * * *